US008593495B2

(12) United States Patent
Takezawa

(10) Patent No.: US 8,593,495 B2
(45) Date of Patent: Nov. 26, 2013

(54) IMAGE FORMING APPARATUS THAT FORMS IMAGE BY SCANNING PHOTOSENSITIVE MEMBER WITH MULTIPLE BEAMS

(75) Inventor: Satoru Takezawa, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/314,358

(22) Filed: Dec. 8, 2011

(65) Prior Publication Data

US 2012/0148277 A1 Jun. 14, 2012

(30) Foreign Application Priority Data

Dec. 14, 2010 (JP) ..... 2010-278297

(51) Int. Cl.
*B41J 2/47* (2006.01)
*B41J 2/435* (2006.01)

(52) U.S. Cl.
USPC ..... 347/235; 347/236; 347/246; 347/250

(58) Field of Classification Search
None
See application file for complete search history.

(56) References Cited

U.S. PATENT DOCUMENTS

| | | | | |
|---|---|---|---|---|
| 6,882,454 | B2 | 4/2005 | Inukai | |
| 2008/0049797 | A1 * | 2/2008 | Morisawa et al. | 372/24 |
| 2008/0204846 | A1 * | 8/2008 | Itabashi et al. | 359/237 |
| 2011/0141536 | A1 * | 6/2011 | Tatsuno | 359/204.1 |

FOREIGN PATENT DOCUMENTS

| | | | |
|---|---|---|---|
| JP | 2002-040350 | A | 2/2002 |
| JP | 2003-025626 | A | 1/2003 |
| JP | 2005-062570 | A | 3/2005 |
| JP | 2005-335166 | A | 12/2005 |

* cited by examiner

*Primary Examiner* — Matthew Luu
*Assistant Examiner* — Kendrick Liu
(74) *Attorney, Agent, or Firm* — Rossi, Kimms & McDowell LLP

(57) ABSTRACT

An image forming apparatus that generates a synchronization signal without breaking laser diodes (LDs). The LDs output beams, which in turn are deflected to scan a photosensitive member. The synchronization signal is generated upon detecting the deflected beams. The LDs output the beams so as to generate the synchronization signal, based on which the output timing of the beams from the LDs is controlled. It is possible to select a first mode in which at least two of the LDs output the beams so as to generate the synchronization signal, and a second mode in which one of the LDs output the beams so as to generate the synchronization signal. The value of drive current supplied to at least two of the LDs when the first mode is selected is smaller than the value of drive current supplied to one of the LDs when the second mode is selected.

6 Claims, 12 Drawing Sheets

IMAGE FORMING APPARATUS THAT FORMS IMAGE BY SCANNING PHOTOSENSITIVE MEMBER WITH MULTIPLE BEAMS

BACKGROUND OF THE INVENTION

1. Field of the Invention

The present invention relates to an image forming apparatus that forms an image by scanning a photosensitive member with a plurality of beams.

2. Description of the Related Art

For electrophotographic image forming apparatuses such as laser beam printers which form an image by scanning a photosensitive member with beams, a scanning optical system in which beams output from light-emitting devices (hereafter referred to as "LDs") are collected by a lens system, the collected beams are deflected by a polygon mirror with rotation of a scanner motor, and the deflected beams scan the photosensitive member has been widely used.

For image forming apparatuses having this scanning optical system, the technique to form an image by scanning a plurality of beams at the same time from an increased number of LDs has been proposed so as to realize higher speed image formation and higher resolution. Particularly in a vertical cavity surface emitting laser (hereafter referred to as a "VCSEL"), light emission points can be arranged in a two-dimensional pattern, and many emission points can be arranged on one chip.

Examples of techniques relating to image forming apparatuses that form an image by scanning beams on a photosensitive member include a technique to perform auto power control (hereafter referred to as "APC") so as to maintain the light quantity of beams on the photosensitive member constant during image formation. Methods of APC include a method in which LDs are lighted up for a predetermined time period, the light quantity of beams is detected by light quantity detecting units (PD: photodiodes) provided inside or outside the LDs, and drive current for outputting beams according to the detected quantity of emitted light is feedback-controlled.

In general, a PD detects a beam (rear light) going out from an end face of an LD opposite to a light-emitting end face of the LD from which a beam (front light) goes toward a photosensitive member. APC is performed during a time period over which a beam scans a non-image region (a time period over which a beam does not scan the photosensitive member in one scanning cycle). Because APC is performed during this time period, APC can be performed without exposing the photosensitive member to the front light.

It is difficult in terms of layout to provide the same number of PDs, which correspond to respective beams, as the number of LDs, and even if they can be laid out, this would cost much. For this reason, APC is performed by causing a single PD to receive a plurality of beams and successively lighting up a plurality of LDs. Thus, when APC is to be performed, a plurality of LDs are successively lighted up at different times during a time period over which beams scan a non-image region.

However, in a VCSEL whose LDs can be increased with ease, beams are output in a direction perpendicular to a semiconductor substrate, and no beams are output in a direction opposite to that direction. For this reason, APC is difficult in an arrangement in which PDs are placed in the same package as with an edge emitting semiconductor laser, and hence there has been a technique to separate front light using a half mirror and cause the front light to fall on PDs.

There has been disclosed a method in which pencils of light obtained by turning light output from a surface emitting laser into parallel light by a collimator lens and limiting the same by an aperture are separated by a half mirror into light going toward a photosensitive member and light going toward a PD, and APC is performed using a single PD (see, for example, Japanese Laid-Open Patent Publication (Kokai) No. 2002-40350).

The method disclosed in Japanese Laid-Open Patent Publication (Kokai) No. 2002-40350 is a method in which front light is separated by a half mirror method, and the separated beams are caused to fall on a PD to perform APC. In this method, it is necessary to ensure the light quantity of beams going toward a photosensitive member, and thus the light quantity of beams output from LDs has to be large. Moreover, because the light quantity of beams going toward the PD cannot be large, the amplification rate of the PD has to be high, but this will deteriorate responsiveness and signal-to-noise ratio. Moreover, the response speed of the PD generally varies according to its light-receiving area, and hence even if the light-receiving area is widened to increase the quantity of incident light, the response speed of the PD will decrease, and the amount of time for APC will increase. Also, the placement of the half mirror brings about cost increase.

For this reason, there has been proposed a method in which a PD is placed on a beam scanning line, and APC is performed according to the light quantity of received beams (hereafter referred to as "scanning light APC). In this method, the light quantity of beams can be detected only at times when beams fall on the PD on the scanning line.

Moreover, an apparatus that performs scanning light APC has problems explained hereafter. To perform scanning light APC, it is necessary to generate a synchronization signal. However, an initial state in which image formation is going to be started, APC has not been performed yet, and hence it is uncertain how much drive current should be supplied to LDs to generate a synchronization signal. In a case where a synchronization signal is to be generated by supplying drive current of a predetermined value to one LD, the drive current may break the LD because it is overcurrent.

SUMMARY OF THE INVENTION

The present invention provides an image forming apparatus that generates a synchronization signal without breaking light-emitting devices.

Accordingly, a first aspect of the present invention provides an image forming apparatus comprising a photosensitive member, a plurality of light-emitting devices configured to output beams, a scanning unit configured to deflect the beams by rotating, and scan the photosensitive member by the deflected beams, a detecting unit configured to generate a synchronization signal upon detecting the beams deflected by the scanning unit, and a control unit configured to cause the plurality of light-emitting devices to output the beams so as to generate the synchronization signal, and based on the synchronization signal, control output timing of the beams from the plurality of light-emitting devices, wherein the control unit is capable of selecting a first mode in which at least two light-emitting devices among the plurality of light-emitting devices are caused to output the beams so as to generate the synchronization signal, and a second mode in which one light-emitting device among the plurality of light-emitting devices is caused to output the beams so as to generate the synchronization signal, and performs controls such that a value of drive current supplied to at least two light-emitting devices among the plurality of light-emitting devices in a case where the first mode is selected is smaller than a value of drive current supplied to one light-emitting device among the plurality of light-emitting devices in a case where the second mode is selected.

According to the present invention, a synchronization signal can be generated without breaking light-emitting devices.

Further features of the present invention will become apparent from the following description of exemplary embodiments (with reference to the attached drawings).

BRIEF DESCRIPTION OF THE DRAWINGS

FIGS. 5A and 5B are diagrams showing the positional relationship between beams from LDs emitting light in a VCSEL appearing in FIG. 2 and the light quantity sensor, in which FIG. 5A shows a state in which the beams are falling on the light quantity sensor, and FIG. 5B shows a state in which the beams are passing the light quantity sensor.

FIGS. 6A to 6C are graphs in which the vertical axis represents light quantity detection value detected by a light quantity sensor appearing in FIG. 1, and the horizontal axis represents time, in which FIG. 6A shows light quantity detection value in a case where eight LDs are caused to emit light, FIG. 6B shows light quantity detection value in a case where four LDs are caused to emit light, and FIG. 6C shows light quantity detection value in a case where two LDs are caused to emit light.

DESCRIPTION OF THE EMBODIMENTS

The present invention will now be described in detail with reference to the drawings showing an embodiment thereof.

Figure 1:
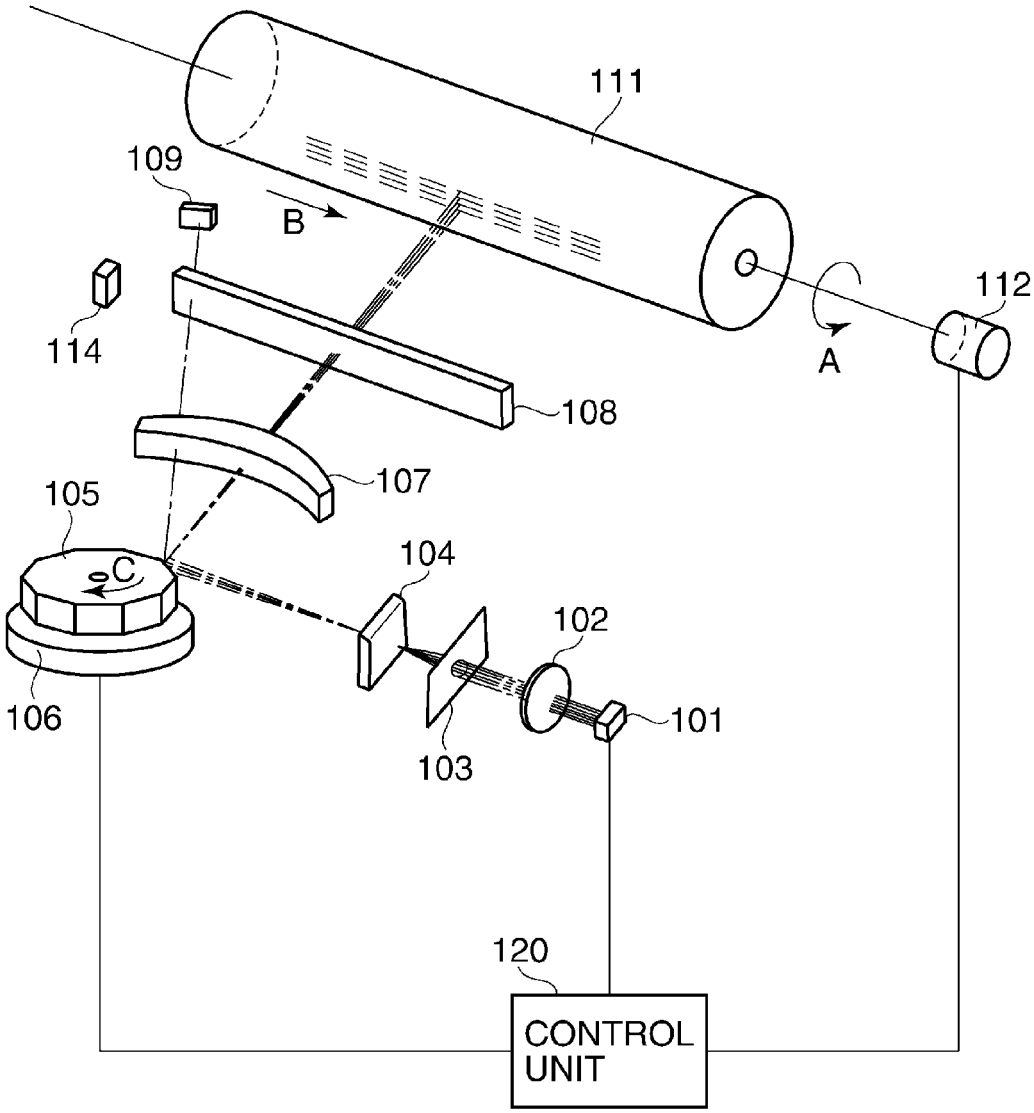
FIG. 1 is a view schematically showing an arrangement of an optical scanning apparatus according to an embodiment of the present invention.

FIG. 1 is a view schematically showing an arrangement of an optical scanning apparatus according to an embodiment of the present invention. Referring to FIG. 1, the optical scanning apparatus 100 includes a light source 101, a collimator lens 102, an aperture stop 103, a cylindrical lens 104, a polygon mirror 105, a scanner motor 106, a toric lens 107, a diffraction optical element 108, a reflective mirror 109, a light quantity sensor 114, a photosensitive member 111, a drive unit 112, and a control unit 120.

The control unit 120 (control unit) supplies drive current to the light source 101 based on image data, thus causing a plurality of light-emitting devices to output beams, and controls a scanner motor 106, the light source 101, and the drive unit 112.

The light source 101 is a vertical cavity surface emitting laser (hereafter referred to as the "VCSEL"). The light source 101 is a semiconductor laser that outputs laser light (front light) perpendicularly to board surfaces of laser light-emitting devices (hereafter referred to as the "LD"), but outputs no laser light (rear light) on the opposite side of the laser light (front light).

Thus, automatic light quantity control (APC) using rear light cannot be performed unlike an edge emitting laser that outputs front light going out from front sides of devices and rear light going out from rear sides of the devices. Therefore, in general, pencils of light obtained after turning outgoing light into parallel light by a collimator lens and limiting the same by an aperture are divided by a half mirror into light going onto a photosensitive member and light going toward a PD, and APC is performed using a single PD.

By using the light source 101, a plurality of main scanning lines can be formed by a single main scan. Moreover, because the VCSEL is used, light can be emitted with high efficiency and low power, and high-speed modulation is possible, and also, because characteristics do not vary widely in response to temperature change, control can be performed more efficiently and more stably.

Because a plurality of main scanning lines can be formed by a single main scan as described above, the rpm of the polygon mirror 105 can be decreased. Conversely, in a case where the rpm of the polygon mirror 105 is not to be decreased, an image can be formed at high speed.

The collimator lens 102 converts beams output from the light source 101 into parallel pencils of light. The aperture stop 103 limits light pencils of beams passing therethrough. The cylindrical lens 104 has a predetermined refractive power only in a sub scanning direction, and causes beams passed through the aperture stop 103 to form line images in a main scanning direction on a reflective surface of the polygon mirror 105. The polygon mirror 105 (main scanning unit) deflects beams from the light source 101 to scan the photosensitive member 111 so as to form an electrostatic latent image on the photosensitive member 111 by the beams. The polygon mirror 105 rotates at constant speed in a direction indicated by an arrow C in the figure, and deflects beams forming an image on the reflective surface to scan the photosensitive member 111. The toric lens 107, which is an optical element having fθ characteristics, is a refractive unit having different refractive indexes in a main scanning direction (direction indicated by an arrow B) and a sub scanning direction (direction indicated by an arrow A). Both of front and rear lens surfaces of the toric lens 107 in the main scanning direction are aspherical. The diffraction optical element 108, which is an optical element having fθ characteristics, is a long diffraction unit having different optical characteristics in the main scanning direction and the sub scanning direction. The light quantity sensor 114 is placed at a location outside a region where the photosensitive member 111 which an image forming apparatus has forms an image (outside an image region), and its light-receiving surface detects the light quantity of beams reflected by the reflective mirror 109.

On the photosensitive member 111, spots of a plurality of beams emitted from the light source 101 are linearly moved in an axial direction through main scanning by the polygon mirror 105. Thus, a strip-shaped electrostatic latent image having a predetermined width is written by a single main scan, and as a result, a latent image that represents an image is formed. The photosensitive member 111 is rotatively driven by the drive unit 112, so that an electrostatic latent image is written in the sub scanning direction.

Figure 2:
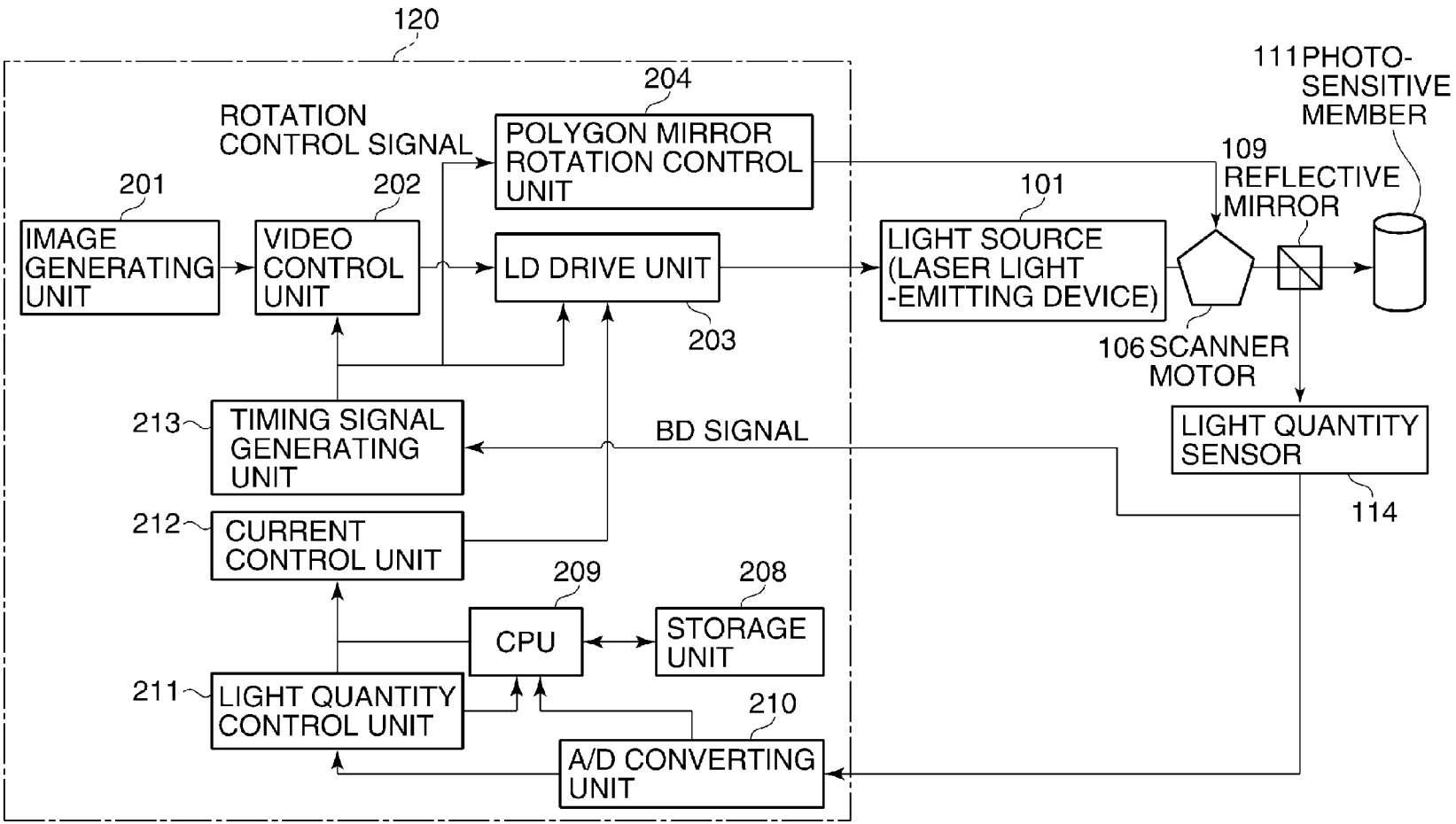
FIG. 2 is a block diagram schematically showing an arrangement of a control unit appearing in FIG. 1.

FIG. 2 is a block diagram schematically showing an arrangement of the control unit 120 appearing in FIG. 1. It should be noted that in FIG. 2, the same component elements as those of the optical scanning apparatus 100 in FIG. 1 are designated by the same reference symbols, detailed description of which, therefore, is omitted.

Referring to FIG. 2, the control unit 120 includes an image generating unit 201, a video control unit 202, a polygon mirror rotation control unit 204, an LD drive unit 203, a timing signal generating unit 213, an A/D converting unit 210, a light quantity control unit 211, a CPU 209, a storage unit 208, and a current control unit 212.

The image generating unit 201 generates image data to be printed, and outputs the generated image data to the video control unit 202. The video control unit 202 outputs the input image data to the LD drive unit 203 with predetermined timing in accordance with main scanning timing and sub scanning timing based on timing signals output from the timing signal generating unit 213. The timing signal generating unit 213 outputs timing signals to the video control unit 202, the polygon mirror rotation control unit 204, and the LD drive unit 203. The timing signal generating unit 213 outputs rotation control signals to the polygon mirror rotation control unit 204.

The LD drive unit 203 sends electric current to the light source 101 so that the light source 101 can emit light to modulate image data with a predetermined quantity of light. The electric current control unit 212 controls current so that the light source 101 can emit a predetermined quantity of light.

The polygon mirror rotation control unit 204 controls polygon mirror rpm so that the polygon mirror 105 rotates in accordance with video signals modulated by the rotation control signals described above and the main scanning timing.

The light quantity sensor 114 (detecting unit) has a light-receiving surface that receives beams, and detects the light quantity of beams reflected by the reflective mirror 109. The mirror is placed on scanning light. Upon receiving beams, the light quantity sensor 114 outputs current or voltage (hereafter referred to as a "light quantity detection value") according to the quantity of received light as a synchronization signal to the timing signal generating unit 213 and the A/D converting unit 210. The A/D converting unit 210 carries out analog-to-digital conversion of the signal output from the light quantity sensor 114, and outputs the resulting signal as a light quantity detection value to the CPU 209 and the light quantity control unit 211.

The CPU 209 controls the entire control unit 120, and stores the above described light detection value in the storage unit 208. At this time, the CPU 209 calculates the quantity of light per laser beam from the quantity of light falling on the light quantity sensor 114 and the number of laser beams, and determines the quantity of light which outputs a plurality of laser beams. A detailed description will be given later of control performed by the CPU 209.

The light quantity control unit 211 compares the light quantity detection value with a reference value, which is a target light quantity, and the light quantity control unit 211 sends the current control unit 212 an instruction to decrease the current value of drive current supplied to the light source 101 when the quantity of light is greater than the reference value, and increase the current value of drive current supplied to the light source 101 when the quantity of light is smaller than the reference value.

Figure 3:
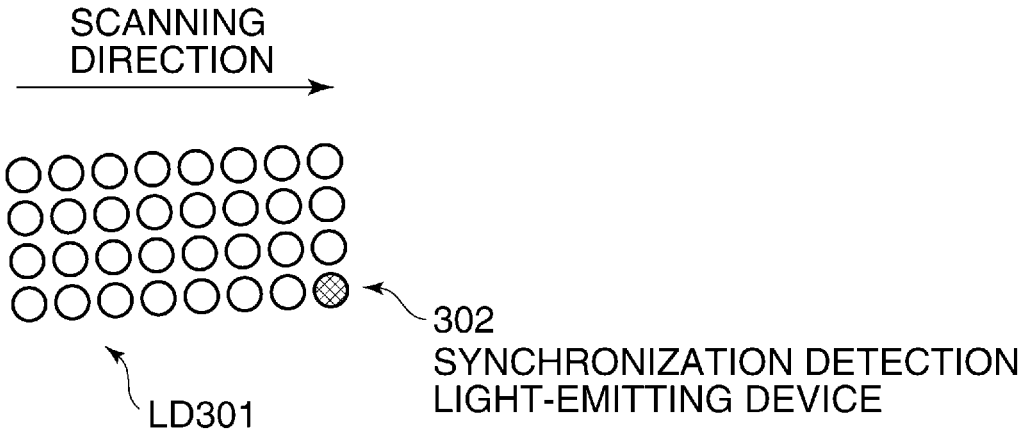
FIG. 3 is a view useful in explaining a light source appearing in FIG. 1.

FIG. 3 is a view useful in explaining the light source 101 appearing in FIG. 1. Referring to FIG. 3, LDs 301 constituting the light source 101 are arranged in a two-dimensional pattern, and during image formation, that is, while an image is being formed based on at least image data, one of the LDs 301 serves as a synchronization detection light-emitting device 302. The synchronization detection light-emitting device 302 is an LD for detecting synchronization between scans.

A brief description will now be given of APC mentioned above. To start APC, at least two LDs among the plurality of LDs 301 are caused to emit light at low current at the same time. For example, when the value of drive current or the value of allowable drive current with respect to the light quantity of beams at the time of image formation is 100%, drive current supplied to LDs is 20% or the like. As this drive current value, a value enough for the total light quantity of beams output from a plurality of LDs to generate a synchronization signal is set (first mode). Namely, the value of drive current in a case where beams are output from a plurality of LDs is smaller than the value of drive current in a case where beams are output from LDs based on image data. It should be noted that the allowable drive current value is a current value over which an LD will be broken. This current value is a value ascertained at the time of design.

In the present embodiment, while synchronization is detected by the light quantity sensor 114 receiving the quantity of light with which synchronization can be detected due to light emission of the plurality of LDs, the plurality of LDs 301 are collectively subjected to rough APC, and then variations in the plurality of LDs 301 are controlled by fine APC.

An outgoing beam for synchronization detection from the synchronization detection light-emitting device 302 passes through various lenses to be scanned by the polygon mirror 105, and is reflected by the reflective mirror 109 provided on a scanning light path, and the light quantity sensor 114 detects the reflected beam to detect synchronization.

The light quantity of a synchronization detection beam has to be the quantity of light with which the light quantity sensor 114 can detect synchronization. For this reason, the value of current applied to the LDs 301 when synchronization detection is started is a current value that causes the LDs 301 to emit light with a quantity of light that enables synchronization detection. However, the quantity of light emitted by the VCSEL varies widely according to temperature as described above even at the same current value, and when predetermined current is applied, the devices of the VCSEL are broken in a case where the quantity of light is greater than a predetermined quantity of light. Also, in a case where the quantity of light is smaller than the predetermined quantity of light, voltage does not reach a threshold value for binary coding, synchronization detection cannot be performed. It is thus necessary to start APC with an appropriate quantity of light.

A description will be given of how to obtain a current value that realizes an appropriate quantity of light when APC is started.

Figure 4:
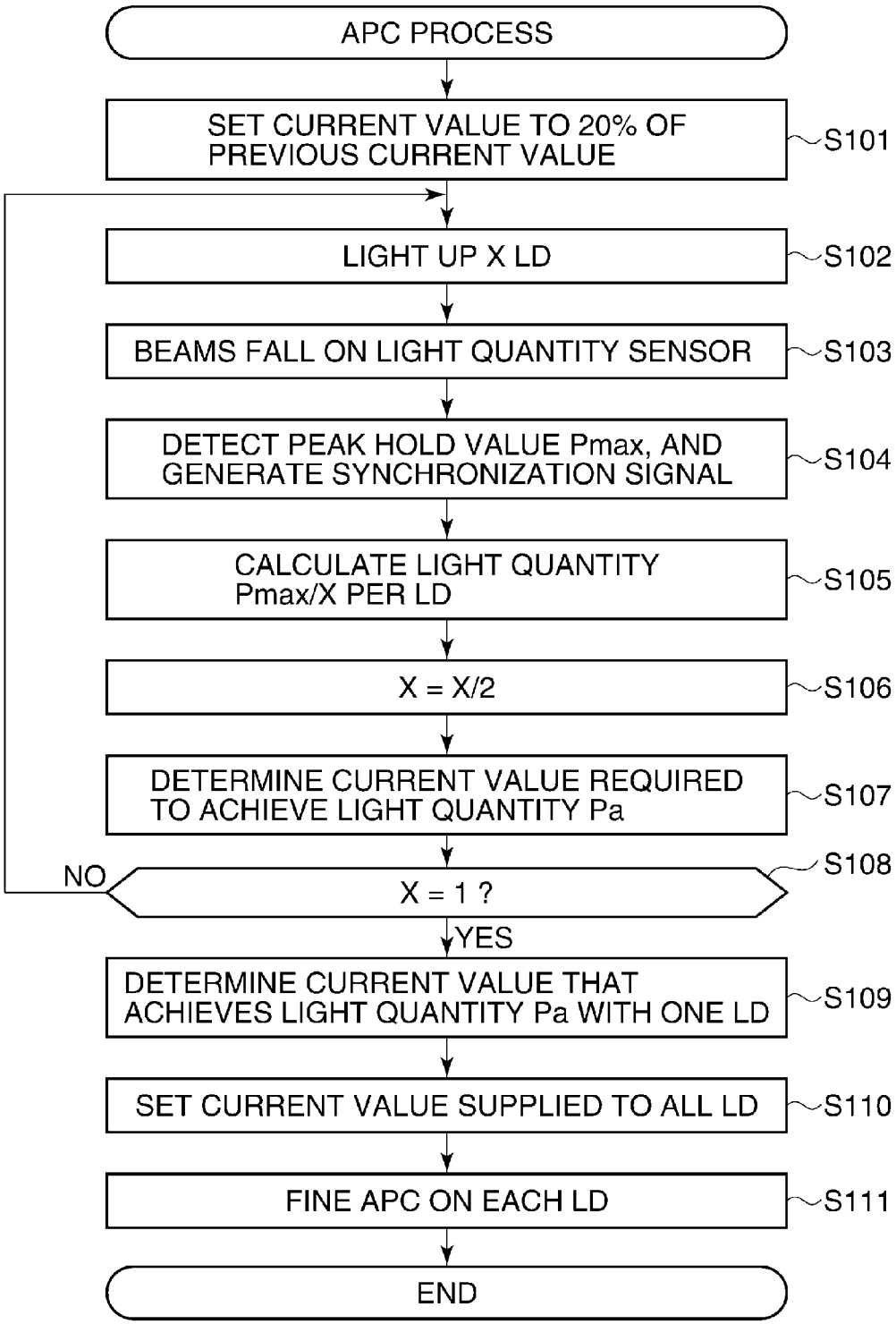
FIG. 4 is a flowchart showing the procedure of an APC process performed by the control unit appearing in FIG. 1.

FIG. 4 is a flowchart showing the procedure of an APC process performed by the control unit 120 appearing in FIG. 1.

The process in FIG. 4 is comprised of a rough APC process in which light quantity detection value is made equal to a quantity of light Pa with which synchronization can be detected (first mode: steps S101 to S109), and a fine APC process in which the quantity of light emitted by each laser light-emitting device is adjusted (second mode: steps S110 to S111).

Referring to FIG. 4, first, in the rough APC process, the control unit 120 reads a current value used in the previous image forming process and stored in the storage unit 208, and sets a current value to 20% of the read current value (step S101). Although 20% is taken as an example here, the current value is determined with consideration given to the number of beams falling on the light quantity sensor 114 and the total quantity of incident light. For example, as characteristics of the LDs 301, any current value may be used insofar as the total quantity of incident light is not less than a quantity of light P2, to be described later with reference to FIG. 9, which can be detected by the light quantity sensor 114 and is a current value that does not cause the LDs to be broken even when the same electric current is passed or even when temperature is a temperature at which the quantity of light is lowest.

Figure 5A:
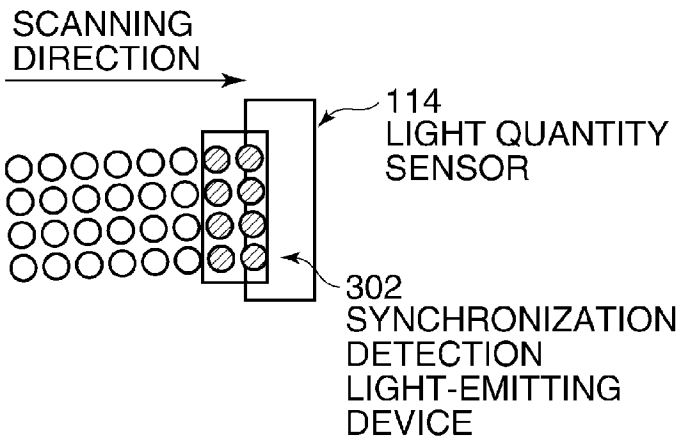

Then, the control unit 120 supplies the set current value to X LDs 301, thus causing these LDs 301 to emit light at the same time (step S102). The LDs 301 caused to emit light at the same time are eight LDs consisting of the synchronization detection light-emitting device 302 and the LDs 301 in the vicinity thereof as shown in FIG. 5A, and they are LDs that can emit a beam which can cover just a light-receiving portion of the light quantity sensor 114. Thus, in this flowchart, "the predetermined number" is eight. It goes without saying that in the present embodiment, the predetermined number is not limited to such a number as to cover just the light-receiving portion, but may be such a number as to cover at least the light-receiving portion.

Figure 6A:
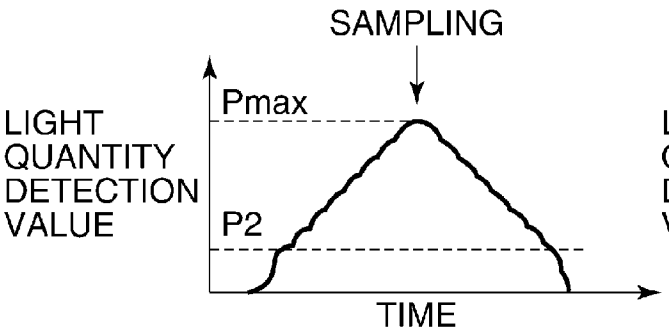

Eight beams scanned by the polygon mirror 105 fall on the light quantity sensor 114 as shown in FIG. 5A (step S103), and when the beams are moving in a scanning direction and falling on the light quantity sensor 114, the light quantity detection value increases over time as shown in FIG. 6A.

Figure 6B:
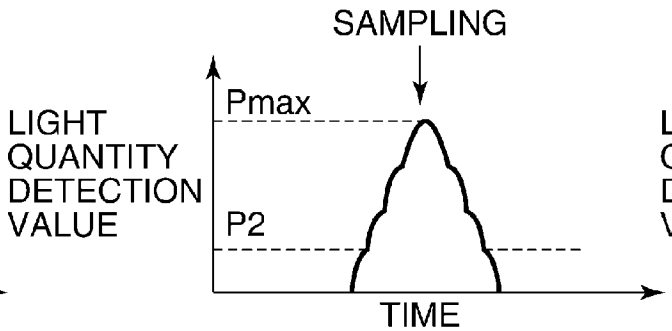
Figure 6C:
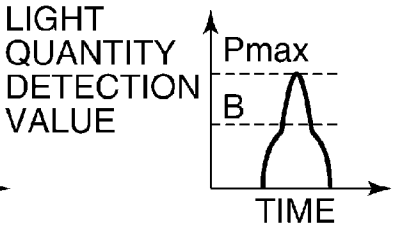

FIGS. 6A to 6C are graphs in which the vertical axis represents the light quantity detection value detected by the light quantity sensor 114 appearing in FIG. 1, and the horizontal axis represents time. FIG. 6A shows the light quantity detection value in a case where eight LDs are caused to emit light, FIG. 6B shows the light quantity detection value in a case where four LDs are caused to emit light, and FIG. 6C shows the light quantity detection value in a case where two LDs are caused to emit light.

Figure 5B:
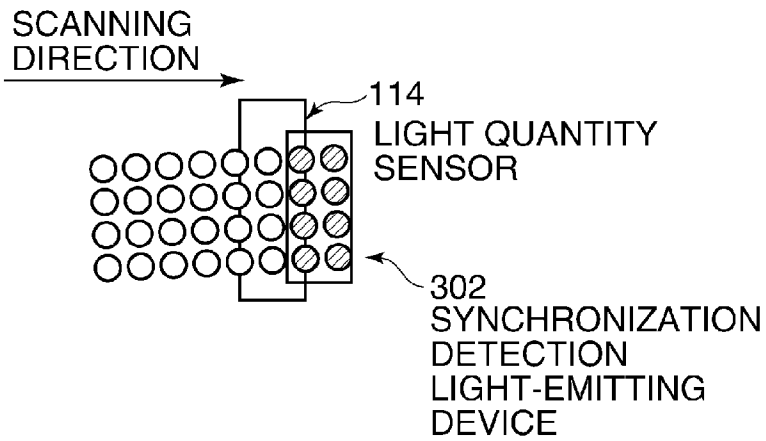
Figure 5B:
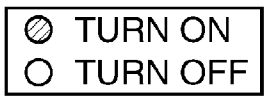

Referring to FIG. 6A, when all the eight beams fall on the light quantity sensor 114, the light quantity detection value reaches its peak (Pmax), and when beams from light-emitting LDs pass the light quantity sensor 114 as shown in FIG. 5B, the light quantity detection value decreases to reach zero. The peak hold value Pmax at this time is detected (step S104), and further, the light quantity detection value at this time is greater than the quantity of light Pa, to be described later with reference to FIG. 7, with which synchronization can be detected, and the quantity of light indicating that beams are incident is detected, and hence a synchronization signal is generated (step S104).

The synchronization detection signal generated in the step S104 is sent to the timing signal generating unit 213, and based on Pmax and the number of LDs caused to emit light, the control unit 120 calculates the quantity of light Pmax/X (here, Pmax/8) emitted from one of the LDs when the beams fall on the light quantity sensor 114 (step S105). Then, the control unit 120 decreases the number of LDs caused to emit light by one-half based on a difference between the quantity of light Pa and Pmax/8 (step S106), and determines a current value I_Pa/4 per LD so that the quantity of light when four beams of light are emitted can be equal to the quantity of light Pa (step S107). Thus, in this flowchart, the number of LDs is decreased by one-half, and the laser light-emitting devices decreased by one-half are replaced with a predetermined number X of laser light-emitting devices (X←X/2). It should be noted that the number of LDs should not always be decreased by dividing it by two, but may be decreased by dividing it by any other value or by subtracting it. The same holds for a flowchart of FIG. 8, to be referred to later.

In a method to calculate the quantity of light per LD, the quantity of light per LD is calculated based on information indicative of the relationship between current value and light quantity stored in advance in the storage unit 208, as well as the quantity of light Pmax/8 per beam and the value of current (supplied current value) I_Pmax/8 supplied to each of LDs caused to emit light at this time. A detailed description will be given later of this method with reference to FIG. 7.

Then, the control unit 120 determines whether or not the number of LDs is one, that is, X is "1" (step S108), and when X is not "1" (NO in the step S108), the processes in the steps S102 to S107 are repeatedly carried out, so that a value that achieves a target quantity of light Pa in X LDs caused to emit light is determined while the number of LDs caused to emit light is decreased. On the other hand, when X is "1" (YES in the step S108), the control unit 120 determines a current value I_Pa that achieves a target quantity of light in one LD (step S109), and carries out the fine APC process in the step S110 and the subsequent steps. It should be noted that in the fine APC process, a synchronization signal is generated by outputting a beam from one LD (the synchronization detection device in FIG. 3) among a plurality of LDs. Then, beams are output from respective LDs with timing based on the synchronization signal to perform APC on each LD.

Thus, in the flowchart of FIG. 4, the control unit 120 decreases the number of LDs and replaces the LDs with the predetermined number X of laser light-emitting devices determined in advance (X←X/2), and repeatedly carries out the processes in the steps S102 to S107, and when the number of light-emitting LDs reaches one, a current value that enables the one LD to emit a target quantity of light is set as the value of current supplied to each of a plurality of LDs. The same holds for flowcharts of FIGS. 8A and 8B, to be referred to later.

In the subsequent fine APC process, first, the control unit 120 sets the value of current supplied to all the other LDs to I_Pa (step S110). In the subsequent step S111, the control unit 120 carries out fine APC to adjust the quantity of light in each LD by, while causing a plurality of LDs to emit light one by one with the current value set in the step S110, comparing the quantity of light detected in the light emission and the quantity of light Pa determined in advance, and then terminates the present process.

Figure 7:
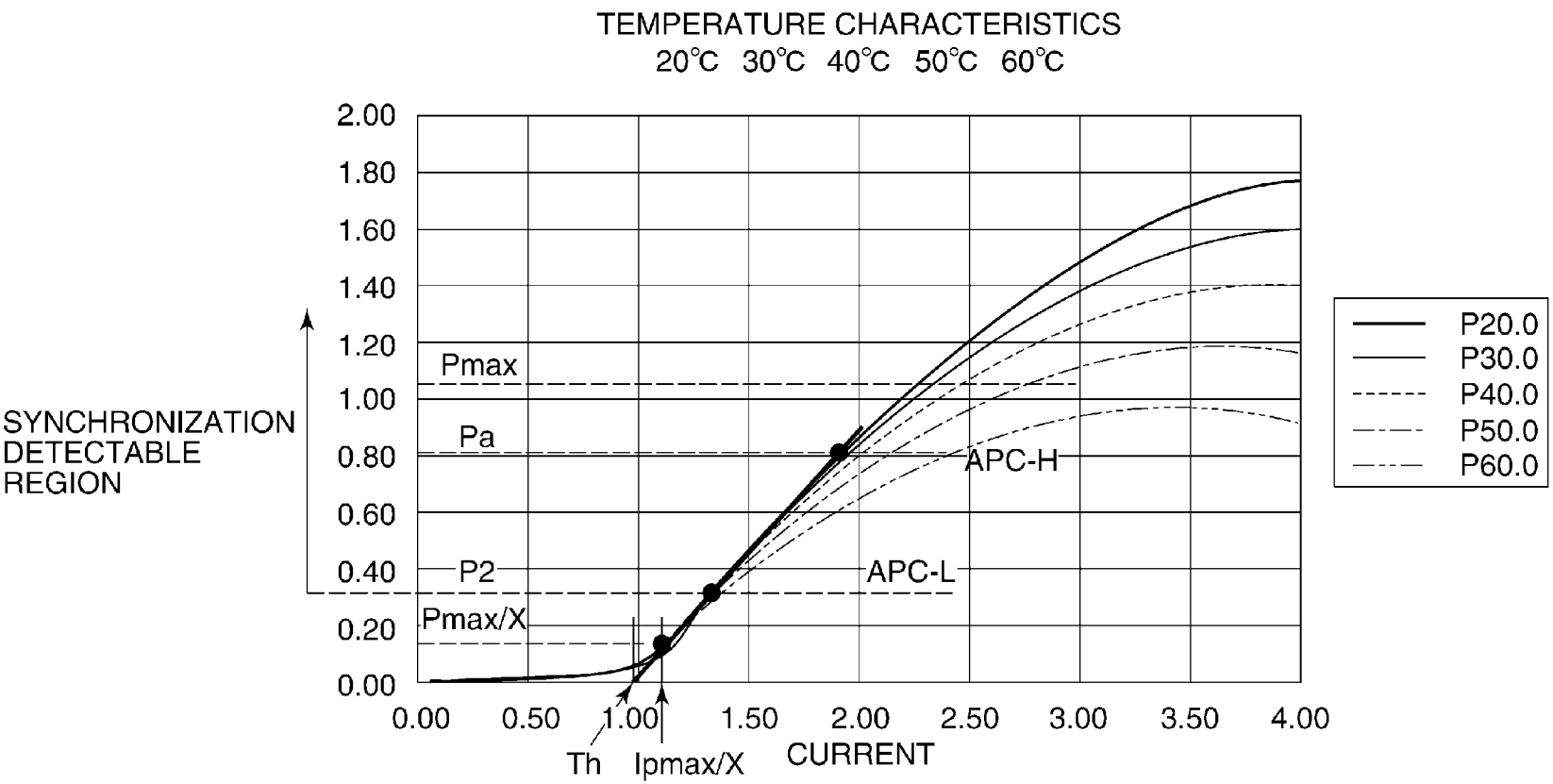
FIG. 7 is a diagram showing the relationship between light quantity detection value at various temperatures detected by the light quantity sensor appearing in FIG. 1 and current value.

FIG. 7 is a diagram showing the relationship between light quantity detection value at various temperatures detected by the light quantity sensor 114 appearing in FIG. 1 and current value.

In FIG. 7, the horizontal axis represents current value, and the vertical axis represents light quantity detection value detected by the light quantity sensor 114.

A description will now be given of how a current value is calculated in the step S107 in FIG. 4.

In terms of LD characteristics, to determine a bias current value which is biased in advance immediately before light emission, the control unit 120 calculates a current threshold value (Th) at which light emission starts. At this time, the control unit 120 adjusts the quantity of light by controlling current with light quantity values in multiple stages.

As shown in FIG. 7, types of APC include, for example, APC in which synchronization can be detected, and the quantity of light is adjusted with the maximum quantity of light in terms of the characteristics of an image forming apparatus, and APC in which the quantity of light is adjusted with a fraction of the maximum quantity of light. Here, of the two-stage APC, APC with high light quantity is denoted as APC-H, and APC in which the quantity of light is adjusted with low light quantity is denoted as APC-L.

During APC, light quantities P-H (Pa) and current values I_P-H in APC-H and light quantities P-L (P2) and current values I_P-L in APC-L are stored in the storage unit 208. I-L characteristics shown in FIG. 7 can be approximated based on those values APC-H, APC-H, and Th.

Thus, the graph in FIG. 7 shows two different light quantities (Pa and P2) and current values (APC-H and APC-L) corresponding to the respective two light quantities.

Assuming that current for Pmax/8 is I_Pmax/8, and a current value that enables light emission at a quantity of light Pa/X (here, Pa/8) which is obtained by dividing the target quantity of light Pa by the number (X) of light-emitting beams, I_Pa/8 is determined by linear interpolation of I-L characteristics in the previous image formation. Here, as shown in the graph of FIG. 7, I-L characteristics in a case where a current value is low or high are relatively nearly linear at any temperature.

Thus, even when the temperature in the previous I-L characteristics and the temperature in the present operation are different, there is only a small difference between the previous I_Pa/8 and the present I_Pa/8. When I_Pa/8 is determined in this way, the control unit 120 then causes half (X/2) of the X LDs that emitted light earlier to emit light at the same time, and calculates a current value I_Pa/4 at a quantity of light Pa/4 received by the light quantity sensor 114.

In a case where four LDs are caused to emit light, the light quantity sensor 114 detects light quantity detection values shown in FIG. 6B and peak-holds and detects a light quantity detection value Pmax at the time when four beams fall on the light quantity sensor 114 at the same time. Likewise, in a case where two LDs are caused to emit light, the light quantity sensor 114 detects light quantity detection values shown in FIG. 6C and peak-holds and detects a light quantity detection value Pmax at the time when two beams fall on the light quantity sensor 114 at the same time.

Moreover, because the above-mentioned fine APC is to control errors only in terms of variations in LDs with respect to the target quantity of light Pa, the fine APC has only to be performed for each LD scan. A description will now be given of the fine APC with reference to FIG. 2 referred to above, and in the following description, the quantity of light differing from the target quantity of light Pa due to variations in LD characteristics is denoted as Pa'.

First, a current value I_Pa' calculated as described above is sent to the current control unit 212, and constant current generated by the current control unit 212 is sent to the LD drive unit 203. Then, when the polygon mirror 105 starts steady rotation, the light source 101 emits one beam in each scan so as to scan the light quantity sensor 114. When scanning light falls on the light quantity sensor 114 via the reflective mirror 109, synchronization is detected, and a synchronization signal is generated. The generated synchronization signal is sent to the timing signal generating unit 213. A light quantity detection value detected by the light quantity sensor 114 at the instant when the synchronization signal was detected is subjected to analog-to-digital conversion by the A/D converting unit 210, and a signal obtained as a result of the conversion is sent to the light quantity control unit 211, so that the APC is started.

Generally, in APC, voltage obtained as a result of voltage conversion, by a voltage converting circuit, of a current value output by the light quantity sensor 114 detecting the quantity of light or voltage directly output from the light quantity sensor 114 is amplified and fed back to current that is to be applied to LDs so that the quantity of light can be equal to a reference value which is a target quantity of light.

A description will now be given of the flow of feedback.

Referring to FIG. 2, a light quantity detection value is subjected to analog-to-digital conversion by the A/D converting unit 210 and sent to the light quantity control unit 211. The light quantity control unit 211 compares the light quantity detection value subjected to analog-to-digital conversion with a reference value which is a target quantity of light, and sends the current control unit 212 an instruction to decrease the current value when the light quantity detection value is greater than the reference value, and increase the current value when the light quantity detection value is smaller than the reference value. The current control unit 212 has a current source therein, and supplies constant current to the LD drive unit 203 in response to an instruction from the light quantity control unit 211. The timing signal generating unit 213 sends the LD drive unit 203 the time at which the quantity of light can be detected next in response to a signal from the light quantity sensor 114, and causes LDs to emit light at a current value from the current control unit 212. Then, the quantity of light at this time is detected by the light quantity sensor 114, and further, the detected quantity of light is fed back to perform the fine APC so that the detected quantity of light can be equal to the target quantity of light.

Thus, the control unit 120 controls the timing with which beams based on image data are output based on a synchronization signal, and causes at least two LDs among a plurality of LDs to output beams so as to generate a synchronization signal. Also, to generate a synchronization signal, the control unit 120 causes a plurality of light-emitting devices to output beams so that the beams can fall on the light-receiving surface of the light quantity sensor 114 at the same time. Further, the control unit 120 controls drive current supplied to a plurality of LDs so that the light quantity of beams output from each of the plurality of LDs can be equal to a predetermined quantity of light based on the light quantity which the light quantity sensor 114 receives, and determines the timing with which the quantity of light from the plurality of LDs is controlled based on a synchronization signal generated by causing at least two LDs among a plurality of LDs to output beams so as to generate a synchronization signal.

According to the process in FIG. 4, a sequential process in which X LDs are turned on (step S102), scanning synchronization is detected upon beams falling on the light quantity sensor 114 (step S104), the quantity of light per LD is calculated (step S105), and a current value required to achieve the quantity of light Pa is determined (step S106) is carried out, so that APC on beams from a plurality of laser light-emitting devices deflected to scan the photosensitive member 111 can be performed in a smaller number of scans. Moreover, because a current value that achieves the quantity of light Pa with one LD is determined by repeatedly carrying out the process while decreasing the number of LDs caused to emit light, synchronization can be quickly detected, and also, in the VCSEL having a number of beams, APC can be performed at high speed. Moreover, because APC can be started at low current, APC can be safely performed without breaking LDs even in a case where there are significant variations in the I-L characteristics of the LDs due to temperature and aging deterioration.

Although in the embodiment described with reference to FIG. 4, the number of LDs caused to emit light is equal to the number of beams which can fall on the light-receiving portion of the light quantity sensor 114, all the LDs may be caused to emit light.

Figure 8A:
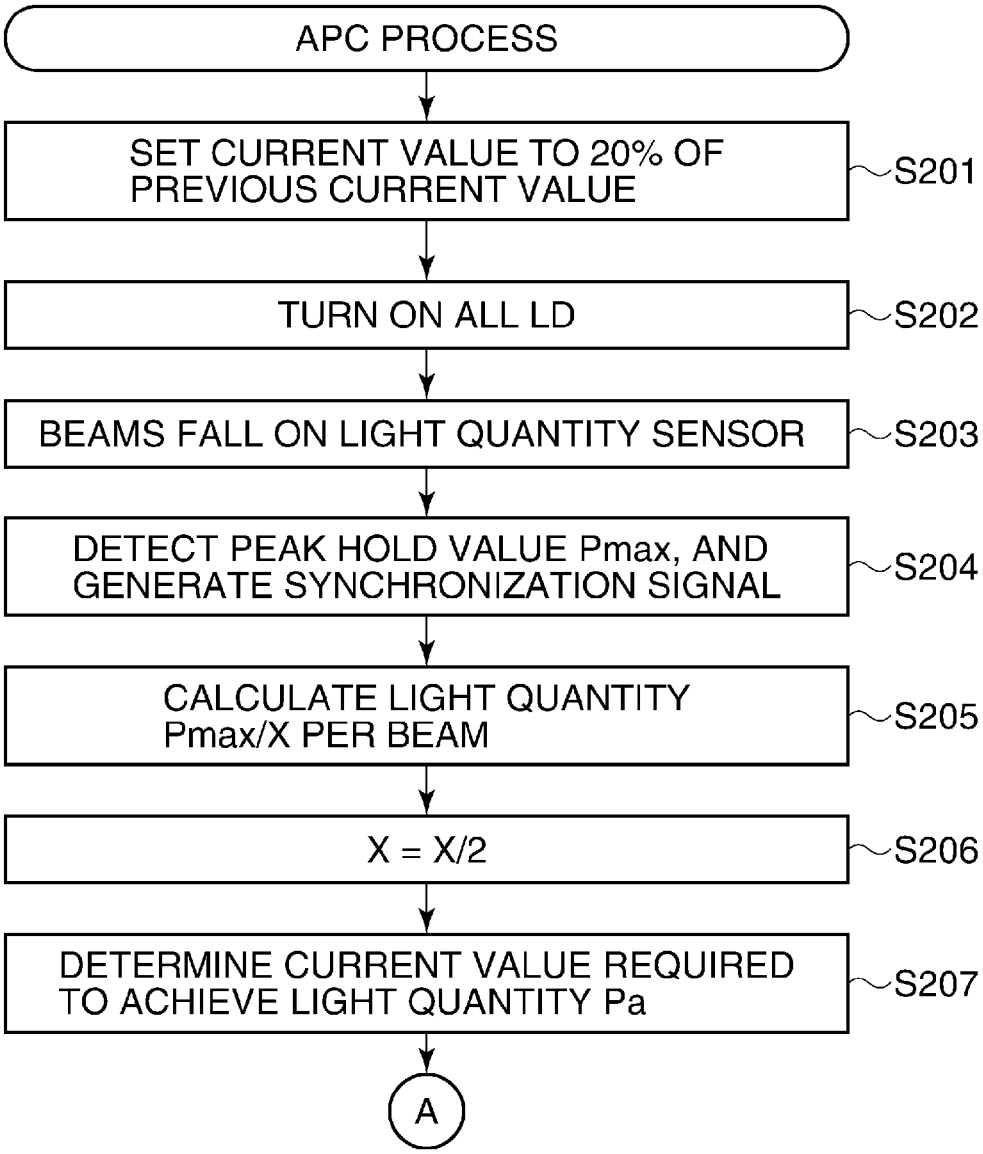
FIGS. 8A and 8B are flowcharts showing the procedure of another APC process performed by the control unit appearing in FIG. 1.
Figure 8B:
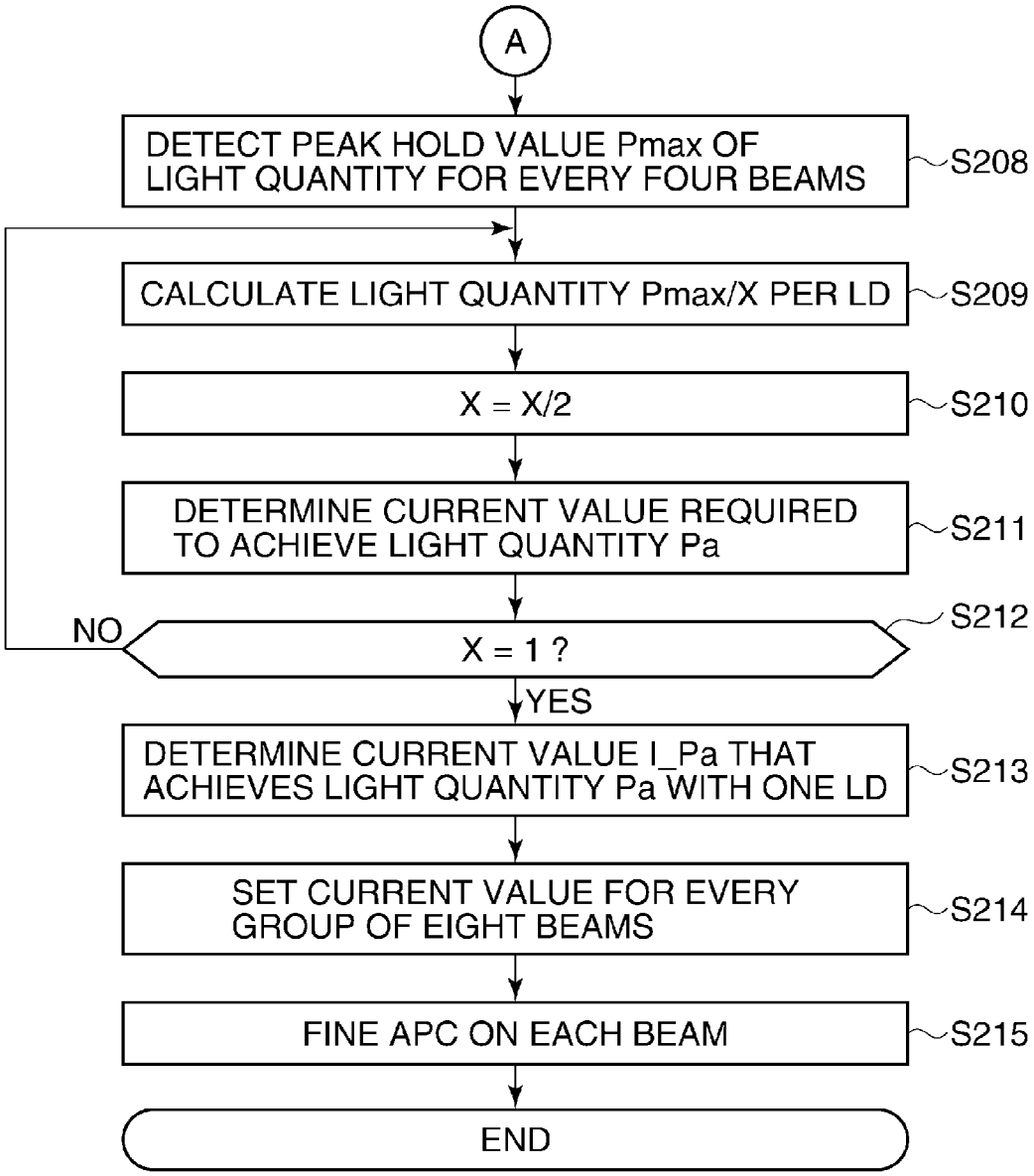

FIGS. 8A and 8B are flowcharts showing the procedure of another APC process performed by the control unit 120 appearing in FIG. 1.

Referring to FIGS. 8A and 8B, first, the control unit 120 reads a current value used in the previous printing process and stored in the storage unit 208, and sets a current value to 20% of the read current value (step S201). Although 20% is taken as an example here, the current value is determined with consideration given to the number of beams falling on the light quantity sensor 114 and the total quantity of incident light. For example, any current value may be used insofar as the total quantity of incident light is more than the quantity of light Pa which can be detected by the light quantity sensor 114 and the current value is a current value that does not cause the LDs 301 to be broken even when the same electric current is passed or even when temperature is a temperature at which the quantity of light is lowest.

Figure 9:
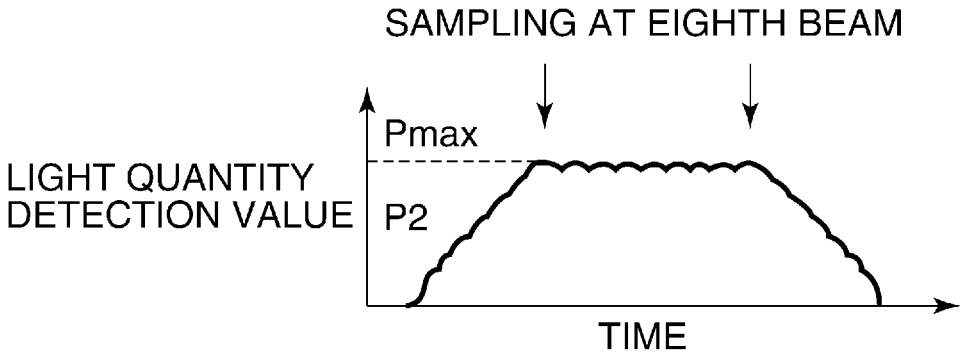
FIG. 9 is a graph in which the vertical axis represents light quantity detection value detected by alight quantity sensor appearing in FIG. 1, and the horizontal axis represents time.

Next, when all the LDs 301 are caused to emit light at the same time (step S202), beams scanned by the polygon mirror 105 fall on the light quantity sensor 114 (step S203). A light quantity detection value detected by the light quantity sensor 114 in the step S203 is shown in FIG. 9.

Figure 10:
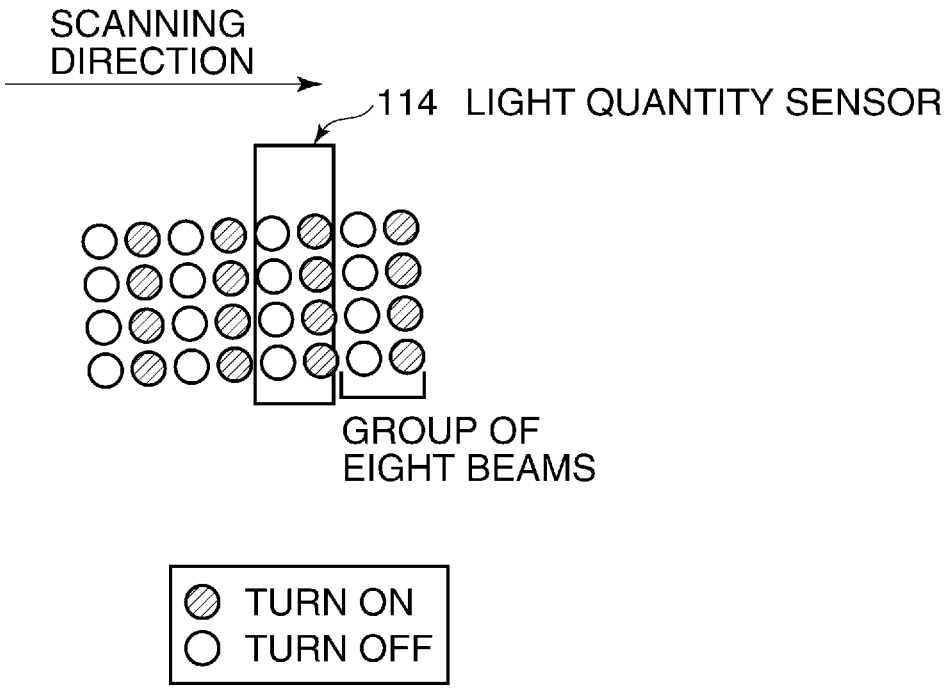
FIG. 10 is a diagram showing the positional relationship between beams from LDs emitting light in the VCSEL appearing in FIG. 2 and the light quantity sensor.
Figure 11:
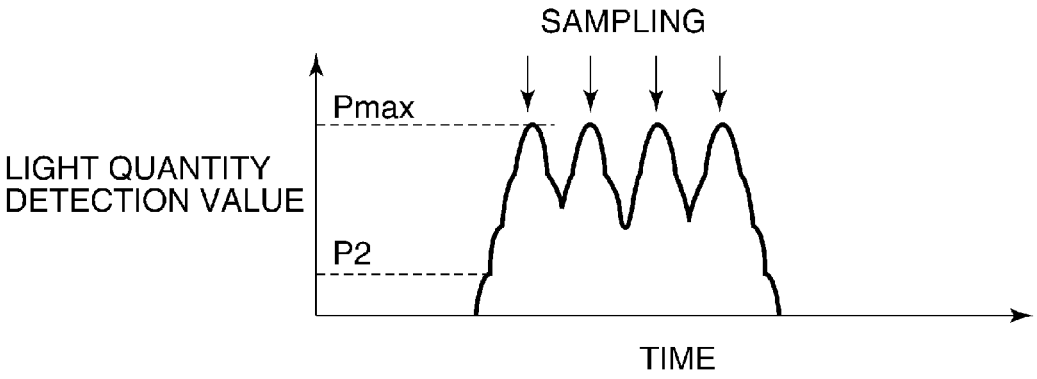
FIG. 11 is a graph in which the vertical axis represents light quantity detection value detected by alight quantity sensor appearing in FIG. 1, and the horizontal axis represents time.

Here, up to eight beams fall on the light quantity sensor 114 at the same time according to the size of the light-receiving portion of the light quantity sensor 114, and hence a plurality of LDs are divided into a predetermined number (eight in the figure) of groups. The I-L characteristics suggest that the quantity of light at the time when eight beams fall on the light quantity sensor 114 satisfactorily exceeds the quantity of light P2 at which synchronization can be detected. At this time, a peak hold value Pmax is detected (step S204), and because the light quantity detection value is more than the quantity of light P2 at which synchronization can be detected, the quantity of light indicative of beams falling on the light quantity sensor 114 is detected, and a synchronization signal is generated (step S204). Moreover, the control unit 120 calculates the quantity of light Pmax/X (here, Pmax/8) in one beam when it falls on the light quantity sensor 114 (step S205), and decreases the number of LDs caused to emit light by one-half (step S206). Here, the pattern in which LDs are caused to emit light is a pattern in which four LDs are caused to emit light at intervals of four LDs as shown in FIG. 10. As a result, beams emit from sixteen LDs of four LDs fall on the light quantity sensor 114. Then, the control unit 120 determines a current value in the same way as in the step S107 (step S207). A light quantity detection value detected by the light quantity sensor 114 at this time is shown in FIG. 11. Four peaks are sampled as shown in FIG. 11 (step S208). Examples of the sampling method include a method in which a time period is measured using a counter at times when synchronization is detected, and the first peak is sampled, and when a peak is reached again after the lapse of a predetermined time period after the peak is passed, the peak is sampled. However, there is no limitation on the details of the sampling method.

Then, the control unit 120 calculates a quantity of light Pmax/X per beam at this time (step S209), and decreases the number of LDs caused to emit light by one-half (step S210). The number of LDs is decreased by one-half by turning on two beams and turning off two beams in each row in which four beams are emitting light. As described above, a plurality of LDs are divided into a predetermined number (eight in the figure) of groups, and the same number of LDs caused to emit light are subtracted from each group.

Then, the control unit 120 calculates a current value I_Pa/X required to make the quantity of emitted light equal to the quantity of light Pa from the I-L characteristics based on the quantities of light in APC-L and APC-H and current values stored in the storage unit 208 (step S211).

Then, the control unit 120 determines whether or not X is "1" (step S212), and when X is not "1" (NO in the step S212), the processes in the step S208 and the subsequent steps are repeatedly carried out, so that a value that makes the quantity of light emitted by X LDs caused to emit light equal to the quantity of light Pa is determined while the number of LDs caused to emit light is decreased. On the other hand, when X is "1" (YES in the step S212), the control unit 120 determines a current value I_Pa that achieves a target quantity of light in one LD (step S213). The control unit 120 sets I_Pa with respect to each group (step S214), and this completes the rough APC. Then, the control unit 120 performs the fine APC for each LD (step S215), and terminates the present process.

According to the process in FIGS. 8A and 8B, all the LDs are turned on (step S202), scanning synchronization is detected upon beams falling on the light quantity sensor 114 (step S204), the quantity of light per LD is calculated (step S205), and a current value required to achieve the quantity of light Pa is determined (step S207). Further, according to the process in FIGS. 8A and 8B, because a peak hold value of light quantity is detected for every four beams (step S208), the quantity of light per LD is calculated (step S209), and a current value required to achieve the quantity of light Pa is determined (step S211), APC on beams from a plurality of laser light-emitting devices deflected and scanned on the photosensitive member 111 can be performed in a smaller number of scans.

Moreover, according to the embodiment of the present invention, because a current value that achieves the quantity of light Pa with one LD is determined by repeatedly carrying out the process while decreasing the number of LDs caused to emit light, synchronization can be quickly detected, and also, in the VCSEL having a number of beams, APC can be performed at high speed. Moreover, because APC can be started at low current, APC can be safely performed without breaking LDs even in a case where there are significant variations in the I-L characteristics of the LDs due to temperature and aging deterioration. Further, because APC is performed on a plurality of groups at the same time, variations in LDs on a chip surface during rough APC can be reduced, and hence the range of adjustment by fine APC can be small, and APC can be quickly completed.

Further, according to the embodiment of the present invention, because the quantity of light can be controlled at high speed when a synchronization signal is generated, it takes only a short time to detect synchronization, and initial APC can be performed at high speed. Moreover, because scanning synchronization can be detected based on the total light quantity of a plurality of beams, APC can be performed at low current, and hence even in a case where the characteristics of LDs vary widely, APC can be performed without breaking the LDs.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-278297 filed Dec. 14, 2010, which is hereby incorporated by reference herein in its entirety.

What is claimed is:

1. An image forming apparatus comprising:

a photosensitive member;

a plurality of light-emitting portions configured to output beams;

a scanning unit configured to deflect the beams so that the beams scan the photosensitive member;

a detecting unit configured to receive the beam or beams deflected by the scanning unit and generate a detection signal; and a control unit configured to cause the plurality of light-emitting portions to output the beams to generate the detection signal, and based on the detection signal generated by the detecting unit, control output timing of the beams from the plurality of light-emitting portions, the control unit performing a light quantity control in which a quantity of the beam emitted from each of the plurality of light-emitting portions is controlled based on the generated detection signal, wherein the control unit is further configured to:

select a first mode in which at least two light-emitting portions among the plurality of light-emitting portions output the beams for detection by the detection unit, and a second mode in which one light-emitting portion among the plurality of light-emitting portions outputs the beam for detection by the detection unit; and select the first mode prior to performing the light quantity control and control a value of drive current so that the value of drive current supplied to at least two light-emitting portions in a case where the first mode is selected is smaller than the value of drive current supplied to one light-emitting portion in a case where the second mode is selected.

2. An image forming apparatus according to claim 1, wherein:

the detecting unit comprises a light-receiving surface that receives the beam or beams, and to cause the detecting unit to generate the detection signal, the control unit controls the plurality of light-emitting portions to output the beams so that the beams fall on the light-receiving surface at the same time.

3. An image forming apparatus according to claim 1, wherein in a case where the first mode is selected, the control unit controls, based on a light quantity of the beam or beams received by the detecting unit, the drive current supplied to the plurality of light-emitting portions so that a quantity of light in the beams output from respective ones of the plurality of light-emitting portions is equal to a quantity of light determined in advance.

4. An image forming apparatus according to claim 3, wherein the control unit determines timing to control light quantities in light-emitting portions other than the at least two light-emitting portions based on the detection signal generated by controlling the at least two light-emitting portions among the plurality of light-emitting portions to output the beams.

5. An image forming apparatus according to claim 1, wherein the control unit generates the detection signal by selecting the first mode immediately after the scanning unit starts rotating, and generates the detection signal by selecting the second mode in a case where an electrostatic latent image is formed on the photosensitive member based on image data.

6. An image forming apparatus according to claim 3, wherein the control unit decreases the number of light-emitting portions to which the drive current is supplied to generate the detection signal upon controlling, in a case where the first mode is selected, the drive current supplied to the plurality of light-emitting portions so that a quantity of light in the beams output from respective ones of the plurality of light-emitting portions is equal to a quantity of light determined in advance.

* * * * *